US005511879A

United States Patent [19]

Fletcher

[11] Patent Number: 5,511,879

[45] Date of Patent: Apr. 30, 1996

[54] SHAKER ATTACHEMENT

[76] Inventor: David J. Fletcher, 18 Lovell Road, Cambridge, CB4 2OR, United Kingdom

[21] Appl. No.: 426,860

[22] Filed: Apr. 24, 1995

[30] Foreign Application Priority Data

Apr. 26, 1994 [GB] United Kingdom ..... 9408263

[51] Int. Cl.[6] ..... B01F 11/00; B01F 13/08

[52] U.S. Cl. ..... 366/208; 366/274

[58] Field of Search ..... 366/208, 209, 366/211, 215, 219, 237, 273, 274, 216, 218, 276, 287; 422/99

[56] References Cited

U.S. PATENT DOCUMENTS

| | | | |
|---|---|---|---|
| 3,184,222 | 5/1965 | Aronowitz | 366/209 |
| 4,109,319 | 8/1978 | Brandt | 366/219 |
| 4,747,693 | 5/1988 | Kahl | 366/208 |
| 4,991,973 | 2/1991 | Maaz | 366/274 |
| 5,060,151 | 10/1991 | Mikyska | 366/208 |

*Primary Examiner*—Robert W. Jenkins
*Attorney, Agent, or Firm*—Anthony F. Cuoco

[57] ABSTRACT

An orbital shaking device (56) for use with a magnetic stirring device having a driving magnet (52) mounted on the motor shaft of an electric motor (54). The orbital shaking device comprises a base structure (58, 60) and a outer plate (62) arranged in parallel alignment and each of which is provided with support means on opposing faces thereof. The support means (96, 102) on the opposing faces are adapted to allow orbital movement of the outer plate (62) relative to the stationary base plate (60) in its own plane. The outer plate (60) is also associated with a driven magnet (66) and orbital movement of the outer plate is effected by magnetic coupling of the driven magnet (66) on the outer plate to the driving magnet (52) of the magnetic stirring device. A reduction gearing means (76) is provided through which the outer plate (62) is driven by the driven magnetic field means (66) to increase torque applied thereto.

5 Claims, 2 Drawing Sheets

SHAKER ATTACHEMENT

Figure 1:
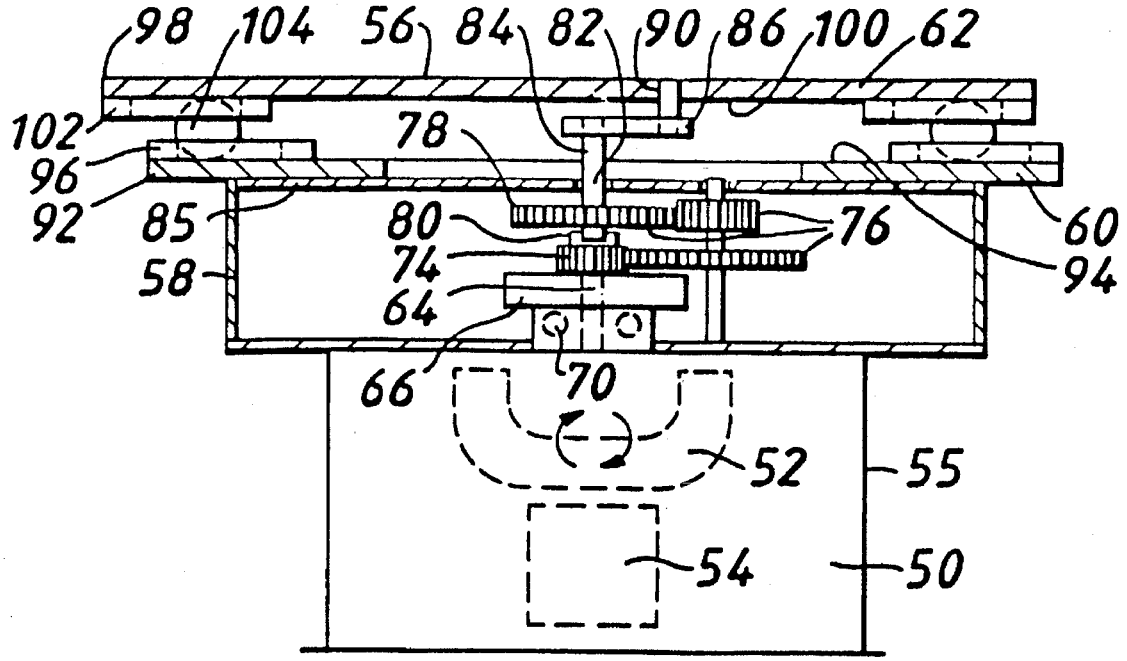

The present invention relates to an orbital shaking ice for use with a magnetic stirring device.

Existing devices used to shake vessels containing liquid generally comprise a vessel support table or platform which is mounted so as to be movable in a circular, gyratory motion. Movement of the vessel support table is conventionally effected by an electric motor. Such devices are commonly referred to as orbitial shakers.

Vessels containing liquids to be agitated are placed upon the vessel support table and the circular motion of the table acts upon the liquid in the vessel to produce a swirling motion thereby stirring and mixing the liquid contents.

It is also known to effect stirring or agitation of materials in a vessel by means of magnetic stirring equipment. Such equipment generally comprises a vessel support table and a magnet mounted on one end of the motor shaft of an electric motor arranged beneath the vessel support table. In use, a vessel whose contents are to be mixed is placed upon the vessel support table and a magnetic bar is placed inside the vessel. When the electric motor is activated, the driving magnet mounted on the motor shaft rotates and the magnetic bar in the vessel follows the motion of the driving magnet thereby mixing the contents of the vessel. Often such magnetic stirring devices also include a heating element so that the vessel contents can be heated and/or stirred.

Such equipment is widely used for example in laboratories to effect efficient mixing of liquid constituents. Often each piece of equipment is dedicated to one particular use or position within the laboratory, in particular, if the equipment is to be used to agitate vessels containing microbial cultures, cellular cultures, radioactive materials or any other material that must be strictly contained to comply with safety regulations for the avoidance of contamination.

A laboratory procedure may also require the use of both types of the aforementioned equipment. For example, it may be necessary to use a magnetic stirring device for the preparation of a culture medium and then an orbital shaking device for culturing microorganisms or cells in the liquid culture medium where continuous agitation during the growth phase is required.

In most laboratories, contamination risks must be stringently regulated and it may not be possible for one piece of equipment to be moved from one work station to another. In such circumstances it is necessary to have each type of equipment required available at each restricted site and as a result, lack of space can be a problem. Furthermore in some circumstances the use of electrical equipment can be hazardous, for example in the presence of materials that are highly combustible or explosive.

It is an object of the present invention to ameliorate the aforementioned problems by providing a magnetic stirring device that is capable of functioning as an orbital shaking device thereby obviating the need for two separate pieces of equipment.

It is a further object of the invention to provide a dedicated orbital shaking device for use in an area where electrical equipment could be a hazard.

The invention provides an orbital shaking device for use with a magnetic stirring device having a driving magnetic field means characterised in that said orbital shaking device comprises a base structure and an outer element disposed in substantially parallel alignment relative to each other said outer element having a driven magnetic field means associated therewith and wherein each of said outer element and said base structure is provided on opposing surfaces thereof with support means said support means being adapted to allow orbital movement of the outer element relative to the base structure, and further comprising reduction gearing means through which said outer element may be driven by said driven magnetic field means to increase the torque applied thereto the arrangement being such that orbital movement of the outer element is effected by magnetic coupling of the driven magnetic field means of the outer element to a driving magnetic field means of a magnetic stirring device.

By magnetically coupling movement of the driven magnet associated with the outer element to the movement of the driving magnet of the magnetic stirrer, the stirrer can be converted to perform an orbital shaking function. The reduction gearing mechanism serves to slow down the revolutions per minute relative to the input speed of rotation and thereby increases the torque. By use of the orbital shaking device of the present invention, a magnetic stirring device can acquire dual functions and thus obviate the need for the provision of separate orbital shaking equipment. This has particular advantages in confined laboratory working conditions.

The orbital shaking device can be used as an attachment for a magnetic stirring device or as a dedicated orbital shaking device which could be used within an oven, incubator, flame proof area or any other vessel or tank where, for example the provision of electrical equipment would be a hazard. Such hazards could be avoided by using the same type of rotating magnetic coupling as described above on the outside of such a container as a means of propulsion.

In a preferred embodiment the support means comprises rolling contact bearings accommodated within seatings formed by alignment of corresponding formations located on opposing surfaces of the base structure and the outer element. In alternative embodiments the support means could comprise resilient members or spring means.

Typically the outer element and the base structure will comprise plates but it will be understood that they could comprise frame members provided they are capable of fulfilling their function. The outer element may be provided with gripping means for receiving and retaining vessels containing materials to be agitated.

In some embodiments the outer element can form the base of a container with the base element and driving magnetic field means being located outside the container in close proximity to the base.

The gear means could also be utilised to drive ancilliary devices such as a liquid pump.

If the magnetic stirring device incorporates a heating mechanism, the heating function can be utilized when the equipment is used as an orbital shaker.

Preferably, the orbital shaking device is constructed of substantially non-ferrous materials, for example aluminium or plastics materials, with the exception of the magnetic field means and possibly any rolling bearings.

According to a second aspect of the present invention there is provided a magnetic stirring device incorporating an orbital shaking device.

Preferably, the base structure of the orbital shaking device is releasably secured to the magnetic stirring device by fixing means.

In some embodiments the fixing means comprises adjustable eccentric cams which permit adjustment of the orbital shaking device relative to the magnetic stirring device.

It will be understood by a person skilled in the art that the number, size and arrangement of the support means can be varied to accommodate different dimensions, load capacities or orbiting excursions of the outer element.

Figure 2:
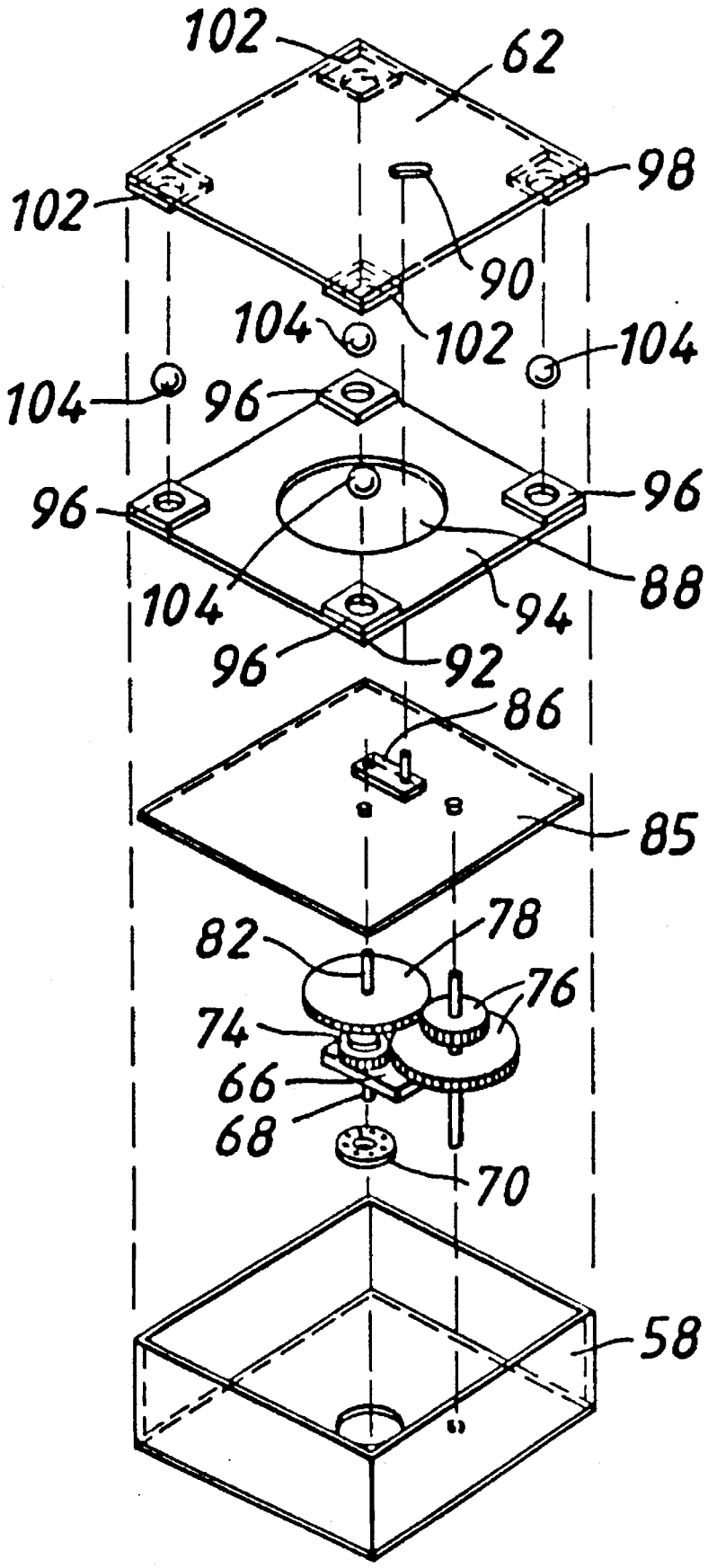

Embodiments of the invention will now be described, by way of example only, with reference to the accompanying illustrative drawings, in which:

FIG. 1 is a partially sectional view of an orbital shaking device and magnetic stirring device constructed in accordance with a preferred embodiment of the invention; and FIG. 2 is an exploded perspective view of the orbital shaking device shown in FIG. 1.

Referring to FIGS. 1 and 2 there is shown an embodiment of the invention. A magnetic stirring device 50 comprises a rotating magnet element 52 coupled to an electric motor means 54 accommodated within a housing 55. The orbital shaking device 56 comprises a top plate 62 and a base structure 58 including a base plate 60.

As shown in FIG. 1, the base structure 58 or gear box, houses a vertically oriented driving rod 64 which has a permanent bar magnet 66 which is to be driven fixed adjacent a lower end 68 thereof. The lower end 68 of the driving rod 64 is mounted on a point bearing 70, the arrangement being such that the magnet 66 and the driving rod 64 can rotate freely on the point bearing 70. The upper end of the driving rod 64 carries a first gear wheel 74 which is arranged in meshing engagement with a further system of interconnecting gear wheels 76. The final gear wheel 78 of the system of gear wheels 76 is carried on a lower end 80 of an output driving rod 82. The upper end 84 of the output driving rod 82 protrudes from the top surface 85 of the base structure 58 and carries an output crank shaft 86. The base plate 60 is disposed on the top surface 85 of the base structure 58 and is provided with a central aperture 88 which is dimensioned to receive the output driving rod 82 and the output crank shaft 86 and to accommodate the travel described by the output crank shaft 86 when the device is in use.

The upper end of the output crank shaft 86 is releasably connected to the outer plate 62 which is located above the base plate 60 and arranged in parallel thereto. The outer plate 62 is provided with an aperture or slot 90 which is positioned to receive and accommodate the upper end of the output crank shaft 86.

At each of the corners 92 of the top surface 94 of the base plate 60 there is provided a support means 96 which in this embodiment comprises a bearing cup and at each of the corners 98 of the underside 100 of the outer plate 62, there is provided a corresponding support means 102. The corresponding support means 96 and 102 are positioned in vertical alignment at each corner of the opposing surfaces 94 and 100 such that a rolling contact bearing or ball bearing 104 can be accommodated between each pair. The rolling contact bearings 104 are dimensioned so that they can move freely within each matched pair of bearing cups thereby allowing the outer plate to undergo orbital motion in its own plane relative to the stationary base plate 60. Accordingly, the outer plate 62 is spaced apart from the base plate 60 by the four rolling contact bearings 104.

Although not shown in FIGS. 1 or 2, there is also provided fixing means for securing the orbital shaker device 56 to the magnetic stirring device 50. Suitable fixing means will be well known to a person skilled in the art but examples could include straps, brackets, screws adjustable eccentric cams or the like.

In order to convert the magnet stirring device 50 to an orbital shaking device, the base structure 58 with the base plate 60 are positioned and fixed onto the housing 55 of the magnetic stirring device 50. Each of the four rolling contact bearings or ball bearings 104 is positioned on each of the four support means or bearing cups 94 arranged at each corner of the top side 94 of the base plate 60. The outer plate 62 is then lowered onto the base plate-base structure assembly so that the corresponding support means or bearing cups 102 located at each corner 98 of the underside 100 of the outer plate 62 are in exact vertical alignment with the support means 96 on the base plate 60 with the four rolling contact bearings or ball bearings 104 accommodated therebetween. At the same time, the output crank shaft 86 is located in the aperture or slot 90 in the outer plate 62.

When the electric motor means 54 of the magnetic stirring device 50 is activated, the driving magnet element 52 carried on the motor shaft rotates. The driven bar magnet 66 attached to the driving rod 64 is magnetically coupled to the driving magnetic element 52 and thus also rotates. Rotation of the driven bar magnet 66 effects rotation of the vertically oriented driving rod 64 which drives in turn the reduction gearing mechanism, the output driving rod 82 and the output crank shaft 86. Eccentric rotation of the crank shaft 86 causes the outer plate 62 to undergo orbital movement in its own plane relative to the stationary base plate. The path of the orbital motion is determined by the ball bearings running in the paired bearing cups.

The gears system serves as a reduction gearing mechanism slowing down the revolutions per minute relative to the input speed of rotation and thereby increasing the torque.

A vessel (not shown) containing liquid to be agitated may be placed on the outer plate 62. The cyclic motion of the outer plate 62 acts upon the liquid in the vessel to produce a swirling motion thereby stirring and mixing the liquid contents.

I claim:

1. An orbital shaking device for use with a magnetic stirring device having a driving magnetic field means characterised in that said orbital shaking device comprises a base structure and an outer element disposed in substantially parallel alignment relative to each other, said outer element having a driven magnetic field means associated therewith and wherein each of said outer element and said base structure is provided on opposing surfaces thereof with support means supporting the outer element and the base structure to allow orbital movement of said outer element relative to said base structure, and further comprising reduction gearing means connected to the outer element and magnetically coupled to said driven magnetic field means for being driven by said driven magnetic field means to increase the torque applied thereto the arrangement being such that orbital movement of the outer element is effected by said magnetic coupling of the driven magnetic field means of the outer element to a driving magnetic field means of a magnetic stirring device.

2. An orbital shaking device as claimed in claim 1 characterised in that the driven magnetic field means comprises a bar magnet.

3. An orbital shaking device as claimed in claim 1 or claim 2 characterised in that the orbital shaking device, excluding the magnetic field means, is constructed of substantially non-ferrous materials.

4. An orbital shaking device as claimed in claim 1 characterised in that the base structure of the orbital shaking device is releasably secured to the magnetic stirring device by fixing means.

5. A magnetic stirring device as claimed in claim 4 characterised in that said fixing means comprises adjustable eccentric cams to permit adjustment of the orbital shaking device relative to the magnetic stirring device.

* * * * *